US005368893A

United States Patent [19]

Sommer et al.

[11] Patent Number: 5,368,893

[45] Date of Patent: Nov. 29, 1994

[54] METHOD AND APPARATUS FOR COATING A MATERIAL WEB, ESPECIALLY A PAPER WEB OR CARDBOARD WEB

[75] Inventors: Herbert Sommer; Günter Franz, both of Düsseldorf, Germany

[73] Assignee: Jagenberg Aktiengesellschaft, Dusseldorf, Germany

[21] Appl. No.: 793,340

[22] PCT Filed: Mar. 27, 1991

[86] PCT No.: PCT/EP91/00596

§ 371 Date: Jan. 22, 1992

§ 102(e) Date: Jan. 22, 1992

[87] PCT Pub. No.: WO91/17309

PCT Pub. Date: Nov. 14, 1991

[30] Foreign Application Priority Data

May 7, 1990 [DE] Germany ..... 4014463

[51] Int. Cl.[5] ..... B05D 1/28; B05D 3/04

[52] U.S. Cl. ..... 427/348; 427/428; 118/63; 118/246; 118/262

[58] Field of Search ..... 118/63, 246, 262; 427/348, 359, 428

[56] References Cited

U.S. PATENT DOCUMENTS

| | | | |
|---|---|---|---|
| 2,679,231 | 5/1954 | Pomper et al. | 118/63 |
| 3,235,401 | 2/1966 | Fowells et al. | 118/63 |
| 4,848,268 | 7/1989 | Sollinger et al. | 118/227 |

FOREIGN PATENT DOCUMENTS

| | | |
|---|---|---|
| 1030168 | 5/1958 | Germany . |
| 1120950 | 12/1961 | Germany . |
| 2419006 | 11/1974 | Germany . |
| 3417487A1 | 11/1985 | Germany . |
| 8414413 | 11/1987 | Germany . |

OTHER PUBLICATIONS

Jagenberg Kunststoff-Beschichtungsanlagen; Jagenberg-Werke AG; Düsseldorf, No. 8174, Plastic Coating Installations, published Apr. 1957.

*Primary Examiner*—Matthew O. Savage
*Attorney, Agent, or Firm*—Herbert Dubno

[57] ABSTRACT

A coating device includes a transfer roller communicating with a bank of coating material and engaging a web of material to be coated, a squeegee bung mounted to resiliently press against a periphery of the transfer roller and to define a contact surface across which the coating material flows, and a counter roller provided with an air blade for final dosing of the coating material applied to the web.

4 Claims, 2 Drawing Sheets

METHOD AND APPARATUS FOR COATING A MATERIAL WEB, ESPECIALLY A PAPER WEB OR CARDBOARD WEB

CROSS REFERENCE TO RELATED APPLICATIONS

This application is a national phase application of PCT/EP91/00596 filed 27 Mar. 1991 and based upon a German Application P 40 14 463.1 filed 7 May 1990 under the International Convention.

FIELD OF THE INVENTION

The invention relates to a device for coating a material web, especially a cardboard web and more particularly for the coating of cardboard with a voluminous application of a uniform covering following the surface contours of the cardboard.

BACKGROUND OF THE INVENTION

U.S. Pat. No. 3,235,401 describes a device of this type with which the material web to be coated is deflected onto a transfer roller from a guide roll of an applicator. The transfer roller drags spreadable dyestuff from a dyestuff bath [tray or trough] and entrains it in excess onto the web. To strip off a part of the spreadable dyestuff applied in excess, the web following the transfer roller is guided over a driven roll squeegee rod [roll doctor rod] provided with a wire wrapping. At a distance from the roll squeegee rod there follows a counter roller about which the web is deflected and whereby, in the looped region of the controllers, an air blade is arranged which strips the surplus spreadable colorant off to the desired coating weight.

It is a disadvantage of known air blade machines, especially with large machine widths, that a closed and uniform coating of the material web can only be produced at limited production speeds (less than 500 m/min).

OBJECT OF THE INVENTION

The invention has as its object to improve a coating device of the type described so that, without a reduction in quality, significantly higher production speeds can be achieved.

SUMMARY OF THE INVENTION

It has been found that, as a final metering device, with an air blade provided for this purpose, because of the over proportional increasing pulses of spreadable dyestuff with increasing web velocity, ever smaller amounts of the surplus can be removed. A condition for a minimal excess application is, however, a very uniform coating without local crowns, for example in the form of strips, which cannot be achieved at high speeds with the conventional coaters. In addition there are difficulties, for example dewatering of the applied spreadable dyestuff, with limited excess quantities, which affect the final metering with the air blade. This effect arises even by premetering upon the web, for example with a squeegee, or a so-called predosing roller.

According to the invention a uniform application is produced on the transfer roller with reduced excess prior to application to the web and which, because of the arrangement of guide roller, is transferred uniformly and in an error free manner to the web. Because of the reduced distance between applicator and air blade, the problems resulting from dewatering of the spreadable dyestuff at final metering are significantly reduced. The dependent claims contain preferred yet especially advantageous forms of the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
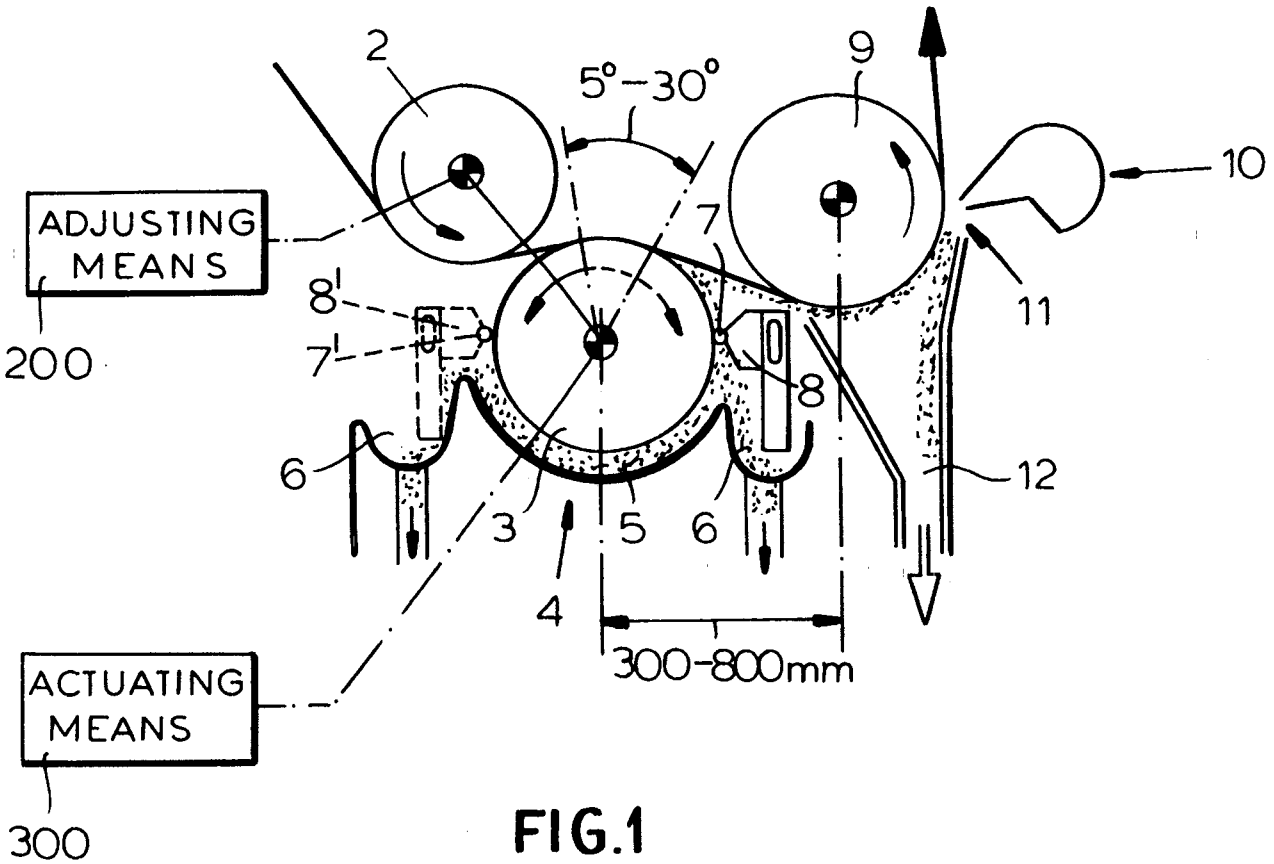
FIG. 1 is a side elevation diagrammatic view of a coating device according to the invention.
Figure 2:
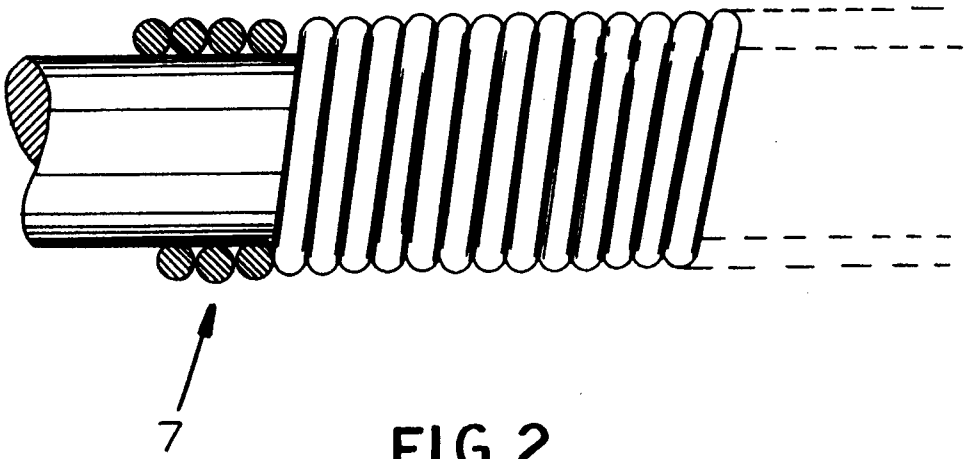
FIG. 2 is a sectional view of a squeegee bar wrapped with wire.

The material web 1 to be coated, a paper web or cardboard web, is deflected about a guide roller to pass tangentially along an upper part of a transfer roller 3 of an applicator 4. The rubber-coated transfer roller has a smooth peripheral surface. It is immersed with its lower part in a dye trough 5 into which the spreadable mass is fed in excess and in which a constant level is maintained by means of overflows or weirs 6 on both sides. The transfer roller 3 is rotated counter to the travel direction of the web 1, whereby the gap to the guide roll 2 amounts to less than 8 mm, preferably 0.5 to 3 mm. Through this limited gap, a laminar application of the web 1 onto the transfer roller 3 is assured, to guarantee a uniform transfer of the spreadable dyestuff from the transfer roller 3 onto the web 1.

Instead of the dye trough 5, some other dye applicator can be arranged on the transfer roller 3, for example a nozzle applicator for delivery of the spreadable dyestuff in excess.

Along the upwardly movable periphery of the transfer roller 3, in the region between the dye trough 5 and web 1, a machine width roll squeegee bar 7 is held in an elastic support 8 which presses the roll squeegee bar 7 with an adjustable pressing force against the surface of the transfer roller 3. The roll squeegee bar 7 driven in the same sense as the transfer roller 3 and thus so that the bar 7 moves against the transfer roller 3, is formed on its surface with rises and recesses. Preferably it has peripheral grooves which can be produced either by a wrapping with a wire or by surface machining. With the use of a wire wrapped squeegee bar 7, the wire has a diameter of 0.6 mm to 1 mm, or alternatively the surface of the squeegee bar 7 is so machined that it has a flow-through cross section corresponding to this wire diameter.

In the web travel direction downstream of the transfer roller 3, there follows at the shortest possible distance a counter rollers 9 about which the web 1 is looped through at least 90°. In the looped region, an air blade 10 is provided as a metering device and has as a substantial component a slit-type nozzle from which an accelerated sharp air jet is directed onto the web 1 to strip off the spreadable colorant until the desired coating weight is reached. Such slit nozzles are known and described, for example, in German Patent 30 48 133 and German Patent 30 48 134. At higher web speeds generally double air blades are used which have two slit nozzles in a single support body. A superatmospheric pressure of 0.3 to 0.8 bar prevails in the slit nozzle 11 and the air emerges through a gap with a gap width of 0.8 mm to 1.5 mm. The excess spreadable colorant removed from the web 1 is collected by a suction unit 12 and recirculated to the dye trough 5.

It has been found that the distance between the transfer roller 3 and the air blade 10 must be as small as possible to avoid a dewatering of the coating dyestuff prior to the final metering. Since both the transfer roller 3 and also the counter rollers 9 for large working widths or machine widths (for example 8 m) must be dimensioned to be correspondingly large (up to 800 mm diameter) on stability grounds. It is required for structural grounds to have a certain distance between the transfer roller 3 and the counter rollers 9—measured as the distance between the two rotary axes. This distance is less than 1500 mm, preferably less than 800 mm.

During the coating, the web 1 is applied smoothly to the transfer roller 3 by the guide roll 2. A web transporting means including the guide roll 2 is provided to transport the web at a web speed. An actuating means 300 is provided to rotate the transfer roller at a peripheral speed that is different from the web speed. The transfer roller 3 sweeps the spreadable dyestuff from the trough 5 in excess and via the roll squeegee 7 this is reduced to 1.1 to 2 times the desired coating weight as applied to the web and the excess is further stripped by the air blade 10 to the final metering quantity. Simultaneously, the roll squeegee rod 7 generates a very uniform film on the surface of the transfer roller 3 which is then transferred onto the web 1. It has been observed that a uniform layer can be generated upon the web 1 with reduced excess when the gap width between the guide roll 2 and the transfer roll 3 is less than 8 mm, and especially lies between a range of 0.5 and 3 mm, and the ratio of web speed/peripheral speed of the transfer roll 3 lies within a predetermined range. The ratio of the two speeds is dependent upon the specific flow cross section A of the squeegee bar 7 at the contact line with the transfer roller 3. Preferably the ratio ranges from 0.015 A to 0.022 A, where A represents the specific flow cross sectional area in $mm^2$ per meter of the squeegee bar length and formed between peripheral surfaces of the squeegee and the roller. With wire-wound squeegee bars with a wire diameter of 1 mm this ratio will range between 1.61 to 2.36.

To enable adjustment of the angle with which the web is slung over the transfer roller 3, the rotary axis of the guide roll 2 is adjustable by any suitable actuating means 200 operatively connected with the axis. Depending upon the paper type and the spreadable dyestuff used, the loop angle on the transfer roller 3 amounts to between 5° and 30°.

So that the final metering by means of the air blade 10 encounters no problems, for example by dewatering of the spreadable dyestuff, the air blade 10 flows with the smallest possible distance downstream of the applicator 4. With the air blade 10, the reduced excess of 10 to 100% is removed so that the desired coating weight is reached.

Preferably the transfer roller 3 is driven counter to the travel direction of the web 1. The squeegee bar 7 is then provided on the outlet side of the web 1 (in FIG. 1 at the right). In certain cases, for example, in the case of air inclusions in the spreadable colorant, the rotary direction of the transfer roller 3 can be reversed so that a codirectional color application is effected. Then the roll squeegee bar 7' with its holder 8' is provided at the inlet side of the transfer roller 3 (indicated in broken lines in FIG. 1). The described advantages here are only partly achieved.

It is an important advantage of the coating device according to the invention that, based upon the very uniform and minimal excess application, very high web speeds can be effected. Especially in the coating of cardboard, production speeds above 500 m/min can be reached even at large working widths (for example 8 m).

We claim:

1. A device for coating a web, said device comprising:

transporting means for transporting a web along a path at a web speed and including a guide roller engaged by the web;

application means along the path for applying a coating substance on the web and including:

reservoir means for accumulating the coating substance, a transfer roller downstream from the guide roller and communicating with said reservoir means and formed with a respective peripheral surface engaged by the web over an arc of said peripheral surface for applying said coating substance to an entire width of the web defined between opposite longitudinal edges of the web, actuating means for rotating said transfer roller at a peripheral speed different from said web speed about a respective axis, a roller squeegee bar for controlling application of said substance to said web, said roller squeegee bar being formed with a respective rotating peripheral surface formed with a plurality of peripheral rises and recesses, elastic means for controllably and resiliently pressing said squeegee bar against an entire length of the peripheral surface of said transfer roller, the peripheral surfaces of said transfer roller and said roller squeegee bar being in contact at a zone across which said substance flows, and means for displacing the guide roller to adjust said arc to between 5° and 10°, wherein said transporting means and said actuating means set a ratio between said web speed and said peripheral speed of the transfer roller of between 0.015 A and 0.22 A, wherein A represents a flow cross section of said zone in $mm^2$ per meter of squeegee bar length, wherein peripheral surfaces of said guide and transfer rollers are spaced apart along said path by a distance of less than 8 mm;

a counter roller rotatable about a respective axis and engaging said web downstream of said transfer roller, said axes of said counter and transfer rollers being spaced apart along said path by a distance less than 1500 mm; and an air blade juxtaposed with said counter roller across said web for final dosing of said substance on said web, said air blade being provided with a slit nozzle having an outlet slit having a slit width between 0.8 and 1.5 mm.

2. The device defined in claim 1 wherein said roller squeegee bar is a squeegee roll whose respective peripheral surface is provided with a wire wrapped thereon, said wire having a diameter ranging between 0.6 mm and 1 mm and corresponding to a distance at which said rises extend radially from the peripheral surface of the squeegee.

3. The device defined in claim 1, further comprising actuating means for rotating said transfer roller at the respective peripheral speed and counter to a travel direction of said web material.

4. A process for coating a web comprising the steps of:

(a) engaging a web to be coated by a guide roller to advance the web along a path at a web speed;

(b) providing a reservoir accumulating a coating substance and spaced from the web along the path;

(c) rotating a transfer roller mounted between the reservoir and web about a roller axis at a peripheral speed different from the speed of the web to deliver the coating substance from the reservoir to the web while pressing the web against an arc of a periphery of the transfer roller downstream from the guide roller; and (d) coating uniformly an entire width of the web defined between opposite longitudinal edges thereof with a predetermined weight of the substance by:

(1) resiliently pressing a rotatable roller squeegee against an entire length of the peripheral surface of the transfer roller to form a contact zone between a periphery of the squeegee formed with rises and recesses and the periphery of the roller, controllably applying thereby an excess amount of said substance flowing across said zone to the web, (2) selecting a flow cross section A of the zone in $mm^2$ per meter of bar length, and setting a ratio between said web speed and the peripheral speed of said transfer roller to be between 0.015 A and 0.022 A, (3) displacing said transfer and guide rollers along said path within a distance ranging between 0.5 mm and 3 mm between peripheral surfaces of said transfer and guide rollers, thereby adjusting the arc to between 5° and 10° for delivering a film of the substance spread uniformly over the periphery of the transfer roller to said web, (4) engaging the web by a counter roller rotatable about a respective axis spaced downstream from the roller axis of the transfer roller by a distance less than 1500 mm, and (5) juxtaposing an air blade provided with a slit nozzle having a slit width between 0.8 and 1.5 mm with the counter roller across the web, thereby removing excess of the substance applied to the web in step (1) to reach the desired coating weight.

* * * * *